US011610721B2

(12) United States Patent
Matsumoto et al.

(10) Patent No.: US 11,610,721 B2
(45) Date of Patent: Mar. 21, 2023

(54) INDUCTOR

(71) Applicant: SHINKO ELECTRIC INDUSTRIES CO., LTD., Nagano (JP)

(72) Inventors: Takayuki Matsumoto, Nagano (JP); Tsukasa Nakanishi, Nagano (JP)

(73) Assignee: SHINKO ELECTRIC INDUSTRIES CO., LTD., Nagano (JP)

( * ) Notice: Subject to any disclaimer, the term of this patent is extended or adjusted under 35 U.S.C. 154(b) by 591 days.

(21) Appl. No.: 16/534,074

(22) Filed: Aug. 7, 2019

(65) Prior Publication Data

US 2020/0075219 A1 Mar. 5, 2020

(30) Foreign Application Priority Data

Sep. 5, 2018 (JP) ..... JP2018-166255

(51) Int. Cl.

| | |
|---|---|
| ***H01F 27/29*** | (2006.01) |
| ***H01F 27/28*** | (2006.01) |
| ***H01F 41/04*** | (2006.01) |
| ***H01F 27/32*** | (2006.01) |

(52) U.S. Cl.

CPC ..... *H01F 27/2804* (2013.01); *H01F 27/29* (2013.01); *H01F 27/32* (2013.01); *H01F 41/041* (2013.01); *H01F 2027/2809* (2013.01)

(58) Field of Classification Search

CPC ..... H01F 27/2804
USPC ..... 336/200
See application file for complete search history.

(56) References Cited

U.S. PATENT DOCUMENTS

| | | | | |
|---|---|---|---|---|
| 6,030,877 | A * | 2/2000 | Lee | H01L 27/08 257/295 |
| 2006/0152321 | A1* | 7/2006 | Jung | H01F 17/0006 336/200 |
| 2008/0061631 | A1* | 3/2008 | Fouquet | H04L 25/0266 307/109 |
| 2015/0035640 | A1* | 2/2015 | Wang | H01F 41/042 336/200 |
| 2015/0270053 | A1* | 9/2015 | Cha | H01F 17/04 336/192 |
| 2018/0366246 | A1 | 12/2018 | Park et al. | |

FOREIGN PATENT DOCUMENTS

| | | |
|---|---|---|
| JP | 2003-168610 | 6/2003 |

* cited by examiner

*Primary Examiner* — Ronald Hinson
(74) *Attorney, Agent, or Firm* — IPUSA, PLLC

(57) ABSTRACT

An inductor includes a magnetic body, and a conductor embedded in the magnetic body. The conductor includes a first conductor, and a second conductor covering a periphery of the first conductor.

10 Claims, 11 Drawing Sheets

INDUCTOR

CROSS-REFERENCE TO RELATED APPLICATION

This application is based upon and claims priority to Japanese Patent Application No. 2018-166255, filed on Sep. 5, 2018, the entire contents of which are incorporated herein by reference.

FIELD

Certain aspects of the embodiments discussed herein are related to an inductor, and a method of manufacturing the inductor.

BACKGROUND

Recently, the size of electronic devices, such as gaming devices, smartphones, or the like is rapidly decreasing. Consequently, there are demands to reduce the size of inductors mounted in such electronic devices. For example, surface mounting (or surface-mount) inductors have been proposed.

Examples of known inductors mounted in the above mentioned electronic device include a film type, a stacked type, a winding type, or the like, for example. The winding type is advantageous from a viewpoint of securing a cross sectional area of conductor patterns, to reduce a Direct Current (DC) resistance. For this reason, various studies have been made to reduce the size of the winding type inductor.

An example of the winding type inductor is described in Japanese Laid-Open patent Publication No. 2003-168610, for example.

However, in the conventional inductor, it is difficult to reduce intervals of adjacent conductor patterns, which makes it even more difficult to further reduce the inductor size.

SUMMARY

Accordingly, it is an object in one aspect of the embodiments to provide an inductor, and a method of manufacturing the inductor, which can reduce the size of the inductor.

According to one aspect of the embodiments, an inductor includes a magnetic body; and a conductor embedded in the magnetic body, wherein the conductor includes a first conductor, and a second conductor covering a periphery of the first conductor.

The object and advantages of the embodiments will be realized and attained by means of the elements and combinations particularly pointed out in the claims.

It is to be understood that both the foregoing general description and the following detailed description are exemplary and explanatory and not restrictive of the invention, as claimed.

DESCRIPTION OF EMBODIMENTS

Figure 1:
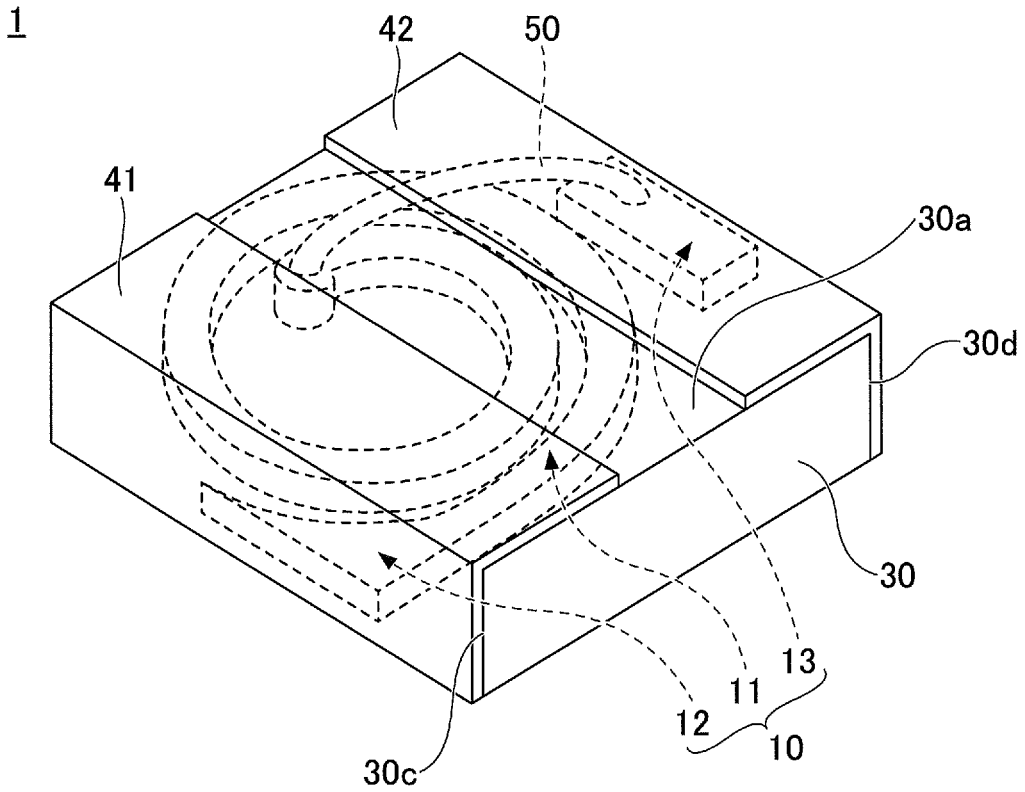
FIG. 1 is a perspective view illustrating an inductor according to a first embodiment.

Preferred embodiments of the present invention will be described with reference to the accompanying drawings. In the drawings, those parts that are the same are designated by the same reference numerals, and a repeated description of the same parts may be omitted.

A description will now be given of an inductor, and a method of manufacturing the inductor according to each embodiment of the present invention.

First Embodiment

[Structure of Inductor]

Figure 2A:
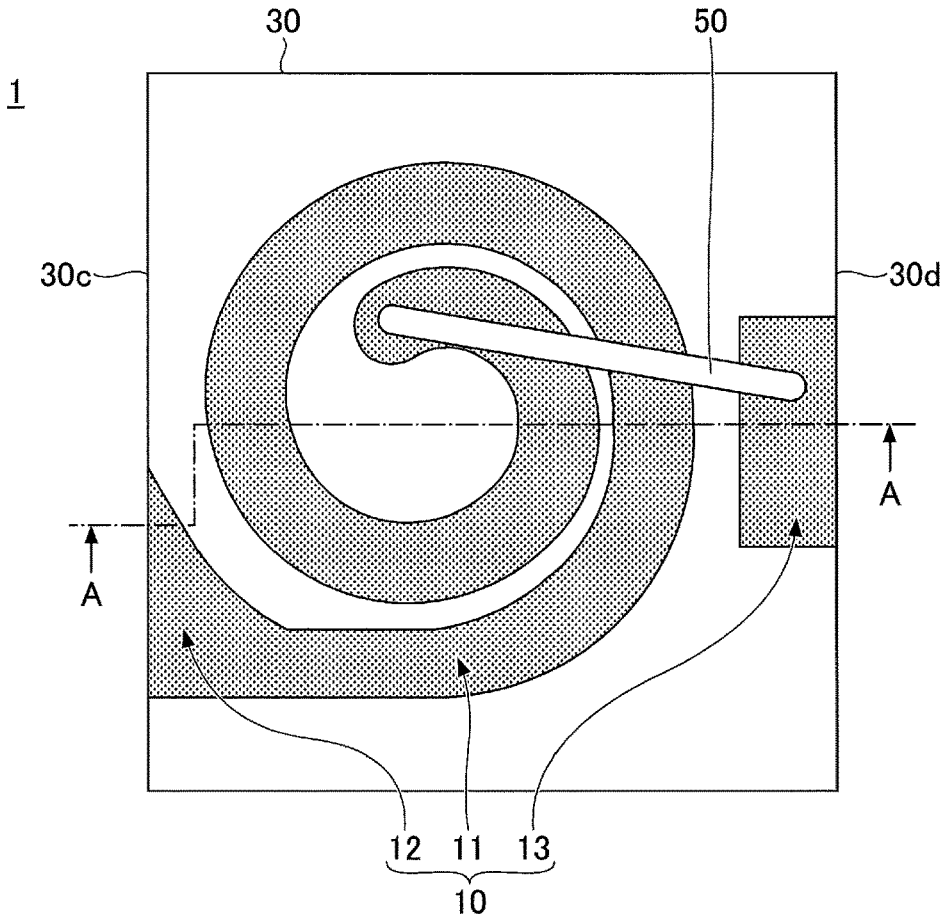
FIG. 2A and FIG. 2B are diagram illustrating the inductor according to the first embodiment.
Figure 2B:
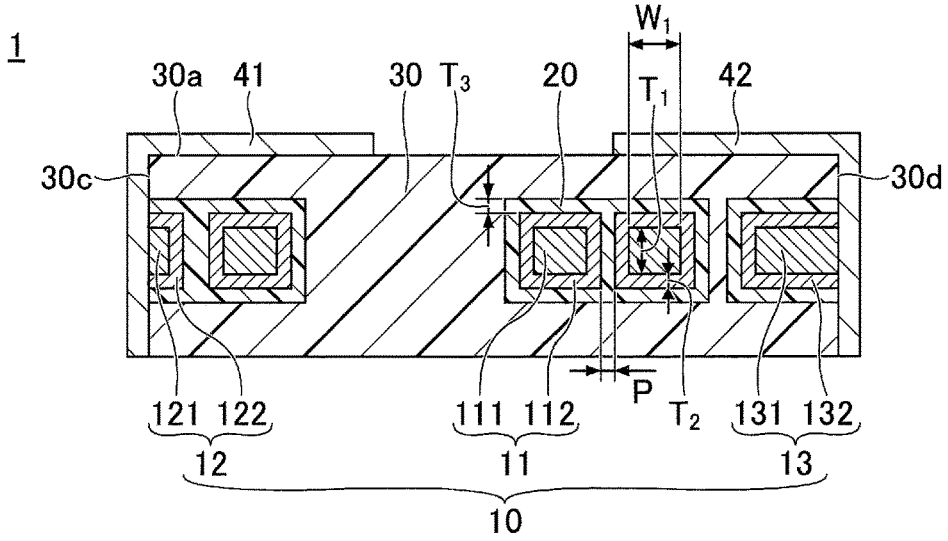

FIG. 1 is a perspective view illustrating an inductor according to a first embodiment. FIG. 2A and FIG. 2B are diagram illustrating the inductor according to the first embodiment. FIG. 2A is a plan view, and FIG. 2B is a cross sectional view along a line A-A in FIG. 2A.

As illustrated in FIG. 1, FIG. 2A, and FIG. 2B, an inductor 1 is a surface mounting inductor which includes a conductor 10, an insulating layer 20, a magnetic body 30, and electrodes 41 and 42. A planar shape of the inductor 1, that is, the shape of the inductor 1 in the plan view, may be approximately rectangular having a size of approximately 3 mm by approximately 3 mm, for example. A thickness of the inductor 1 may be approximately 1.0 mm, for example. The illustration of the insulating layer 20 is omitted in FIG. 1. In addition, the illustration of the insulating layer 20, and the electrodes 41 and 42, is omitted in FIG. 2A, and only an outer edge of the magnetic body 30 is illustrated.

The conductor 10 includes a conductor pattern 11 that is patterned to a spiral shape in the plan view (that is, a planar shape that is a spiral), a first terminal part 12 that is patterned to an approximately triangular shape in the plan view (that is, a planar shape that is approximately triangular), and a second terminal part 13 that is patterned to an approximately rectangular shape in the plan view (that is, a planar shape that is approximately rectangular). The "plan view" of an object refers to a view of the object in a normal direction to an upper surface 30*a* of the magnetic body 30. The "planar shape" of the object refers to the shape of the object in the view in the normal direction to the upper surface 30*a* of the magnetic body 30.

The first terminal part 12 is integrally formed on the conductor pattern 11 at an end of the conductor pattern 11. The second terminal part 13 is arranged independently of the conductor pattern 11 and the first terminal part 12. The other end of the conductor pattern 11 is electrically connected to the second terminal part 13 via a metal wire 50. The metal wire 50 may be a gold wire, a copper wire, an aluminum wire, or the like, for example. The metal wire 50 may be connected to the other end of the conductor pattern 11 or the like by ultrasonic bonding, welding, soldering, or the like, for example.

The conductor pattern 11 includes a first conductor 111, and a second conductor 112 covering a periphery of the first conductor 111. In addition, the first terminal part 12 includes a first conductor 121, and a second conductor 122 covering a periphery of the first conductor 121. Further, the second terminal part 13 includes a first conductor 131, and a second conductor 132 covering a periphery of the first conductor 131.

The first conductor 111, the first conductor 121, and the first conductor 131 may be formed by a metal plate that is patterned by etching or punching. Examples of the material forming the first conductor 111, the first conductor 121, and the first conductor 131 include copper, copper alloys, Fe—Ni alloys (42 alloy or the like), or the like, for example. A thickness $T_1$ of each of the first conductor 111, the first conductor 121, and the first conductor 131 may be approximately 60 μm to approximately 120 μm, for example. A width $W_1$ of the first conductor 111 may be approximately 140 μm to approximately 200 μm, for example.

The second conductor 112, the second conductor 122, and the second conductor 132 may be formed by an electroplated layer. Examples of the material forming the second conductor 112, the second conductor 122, and the second conductor 132 include copper or the like, for example. A thickness $T_2$ of each of the second conductor 112, the second conductor 122, and the second conductor 132 may be appropriately selected within a range so that the second conductors 112, covering the immediately adjacent first conductors 111 of the conductor pattern 11, do not make contact with each other. The immediately adjacent first conductors 111 of the conductor pattern 11 are the first conductors 111 immediately next to each other in FIG. 2B which corresponds to a longitudinal section of adjacent turns of the conductor pattern 11 having the spiral shape illustrated in FIG. 2A. The thickness $T_2$ may be approximately 20 μm to approximately 60 μm, for example. The thickness of each of the second conductor 112, the second conductor 122, and the second conductor 132 formed by the electroplating becomes approximately uniform in the periphery of each of the first conductor 111, the first conductor 121, and the first conductor 131. The "approximately uniform thickness" not only refers to a case where the thickness is perfectly uniform, and an error on the order of a manufacturing error is tolerated. More particularly, the "approximately uniform thickness" includes a case where the thickness with respect to the average thickness is ±10% or less.

An interval (or pitch) P of the immediately adjacent patterns (that is, immediately adjacent second conductors 112) of the conductor pattern 11 in FIG. 2B may be set smaller than the thickness $T_1$ of the first conductor 111. The interval P of the immediately adjacent patterns of the conductor pattern 11 in the longitudinal section may be set to approximately 10 μm, for example.

In the conductor pattern 11, the cross sectional shape of the first conductor 111 along a width direction thereof, illustrated in FIG. 2B, is approximately rectangular. In addition, because the thickness of the second conductor 112 is approximately uniform, the cross sectional shape of the entire conductor pattern 11 along the width direction thereof, illustrated in FIG. 2B, is also approximately rectangular. The "approximately rectangular" shape not only includes a square shape and an oblong shape, but also includes square shapes and oblong shapes having rounded corner parts.

By electroplating the second conductor 112, the immediately adjacent patterns of the conductor pattern 11 can be arranged close to each other at narrow intervals along the width direction of the conductor pattern 11 in the longitudinal section. Hence, compared to an inductor according to a first comparison example in which the second conductor is not provided, the inductor 1 can increase the inductance value using the same external size as the inductor according to the first comparison example. In addition, when obtaining the same inductance value as the inductor according to the first comparison example, the inductor 1 can reduce the external size thereof compared to the size of the inductor according to the first comparison example. Further, because the cross sectional area of the conductor pattern 11 increases, the DC resistance of the conductor pattern 11 can be reduced, and the inductor 1 can allow more current to flow through the inductor 1.

The insulating layer 20 covers the periphery of the conductor 10, including peripheries of the conductor pattern 11, the first terminal part 12, and the second terminal part 13. By covering the periphery of the conductor 10 with the insulating layer 20, it is possible to prevent a short-circuit between the conductor 10 and the magnetic body 30, and a short-circuit between the immediately adjacent patterns of the conductor pattern 11 in the longitudinal section. Examples of an insulating resin forming the insulating layer 20 include epoxy resins, polyimide resins, or the like, for example. A thickness $T_3$ of the insulating layer 20 may be approximately 10 μm, for example.

The thickness $T_3$ of the insulating layer 20 in the periphery of the conductor 10 becomes approximately uniform, by forming the insulating layer 20 by electrodeposition coating, for example.

The magnetic body 30 covers the insulating layer 20. In other words, the conductor 10 which is covered by the insulating layer 20, is embedded in the magnetic body 30. However, a part of the first terminal part 12 is not covered by the insulating layer 20, and is exposed from a side surface 30*c* of the magnetic body 30. In addition, a part of the second terminal part 13 is not covered by the insulating layer 20, and is exposed from a side surface 30*d* of the magnetic body 30.

The magnetic body 30 may have a composition including a magnetic powder and an insulating resin, for example. By adjusting a mixing ratio of the magnetic powder and the insulating resin, it is possible to secure the required permeability, formability, or the like of the magnetic body 30.

An example of the magnetic powder includes a powder of a soft magnetic material, for example. Examples of the powder of the soft magnetic material include powders of iron-based amorphous alloys, carbonyl iron powders, ferrite powders, permalloy powders, or the like, for example. Examples of the insulating resin include thermoplastics and thermosetting resins, such as epoxy resins, polyimide resins, phenol resins, acrylic resins, or the like, for example.

The electrodes 41 and 42 are an example of a pair of electrodes formed on an outer side of the magnetic body 30. The electrode 41 is formed on the upper surface 30*a* of the magnetic body 30 at a position on the side of the side surface 30*c*, and extends from the upper surface 30*a* to the entire side surface 30*c*. The electrode 42 is formed on the upper surface 30*a* of the magnetic body 30 at a position on the side of the side surface 30*d*, and extends from the upper surface 30*a* to the entire side surface 30*d*. The electrode 41 is electrically connected to the part of the first terminal 12 exposed from the side surface 30*c* of the magnetic body 30. In addition, the electrode 42 is electrically connected to the part of the second terminal 13 exposed from the side surface 30*d* of the magnetic body 30. Examples of the material forming the electrodes 41 and 42 include copper or the like, for example. The electrodes 41 and 42 may have a stacked structure in which a plurality of metal layers are stacked.

[Method of Manufacturing Inductor]

Figure 8:
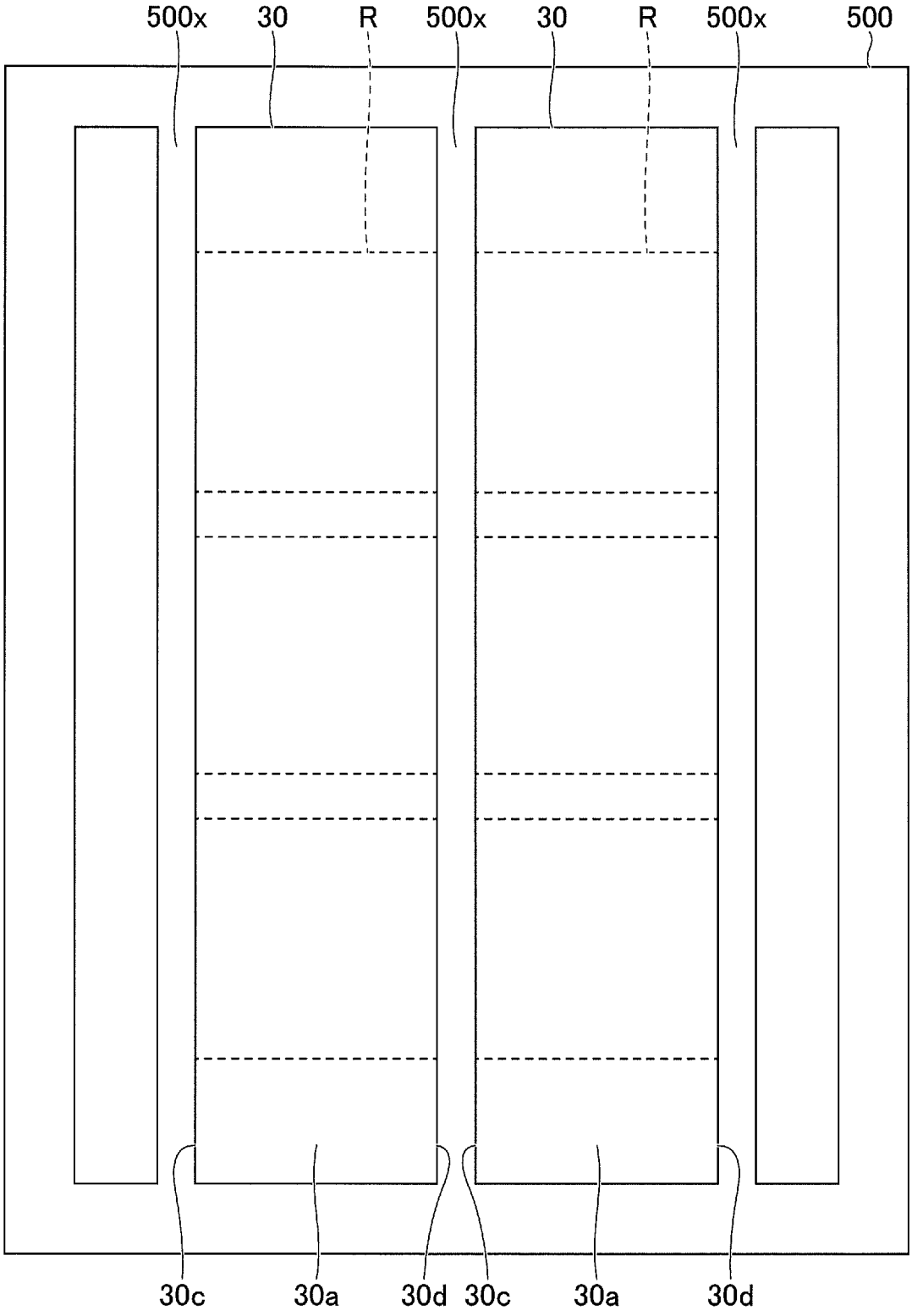
FIG. 8 is a diagram illustrating a manufacturing process of the inductor according to the first embodiment.
Figure 9:
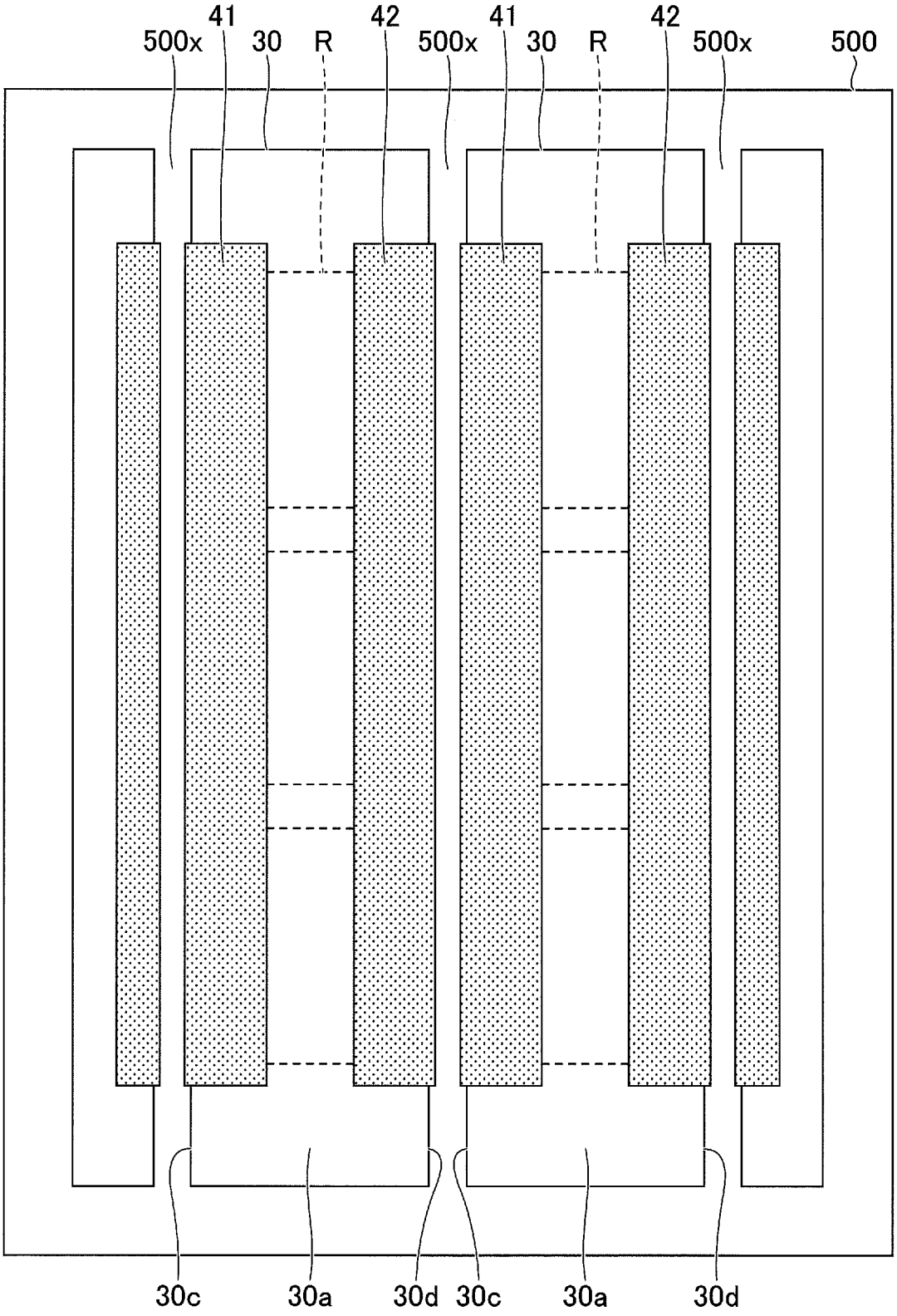
FIG. 9 is a diagram illustrating a manufacturing process of the inductor according to the first embodiment.
Figure 10:
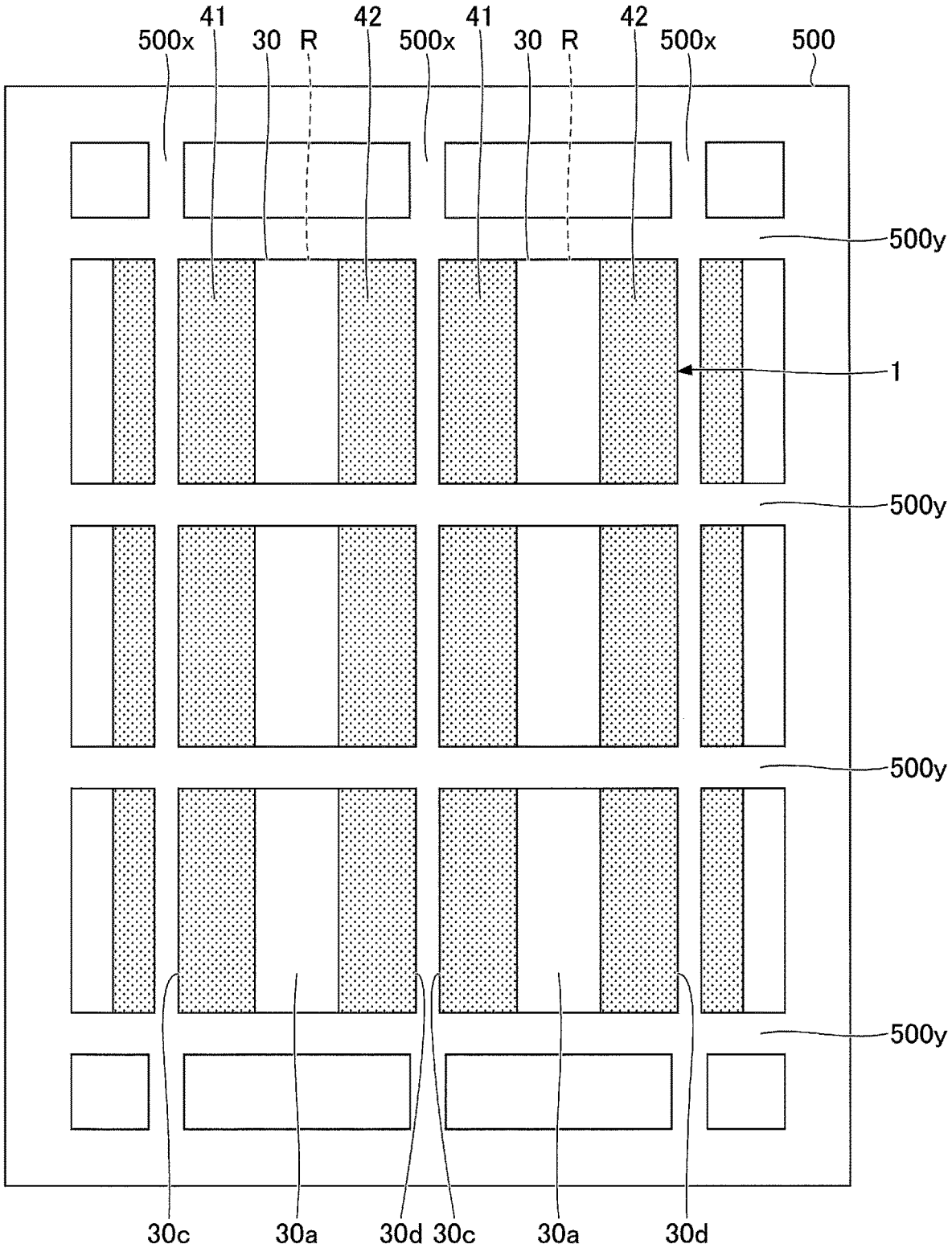
FIG. 10 is a diagram illustrating a manufacturing process of the inductor according to the first embodiment.

Next, a method of manufacturing the inductor according to the first embodiment will be described. FIG. 3 through FIG. 10 are diagrams illustrating manufacturing processes of the inductor according to the first embodiment. FIG. 4A through FIG. 7C will be described by referring to plan views corresponding to FIG. 2A and/or cross sectional views corresponding to FIG. 2B. FIG. 8 through FIG. 10 will be described by referring to plan views corresponding to FIG. 3.

Figure 3:
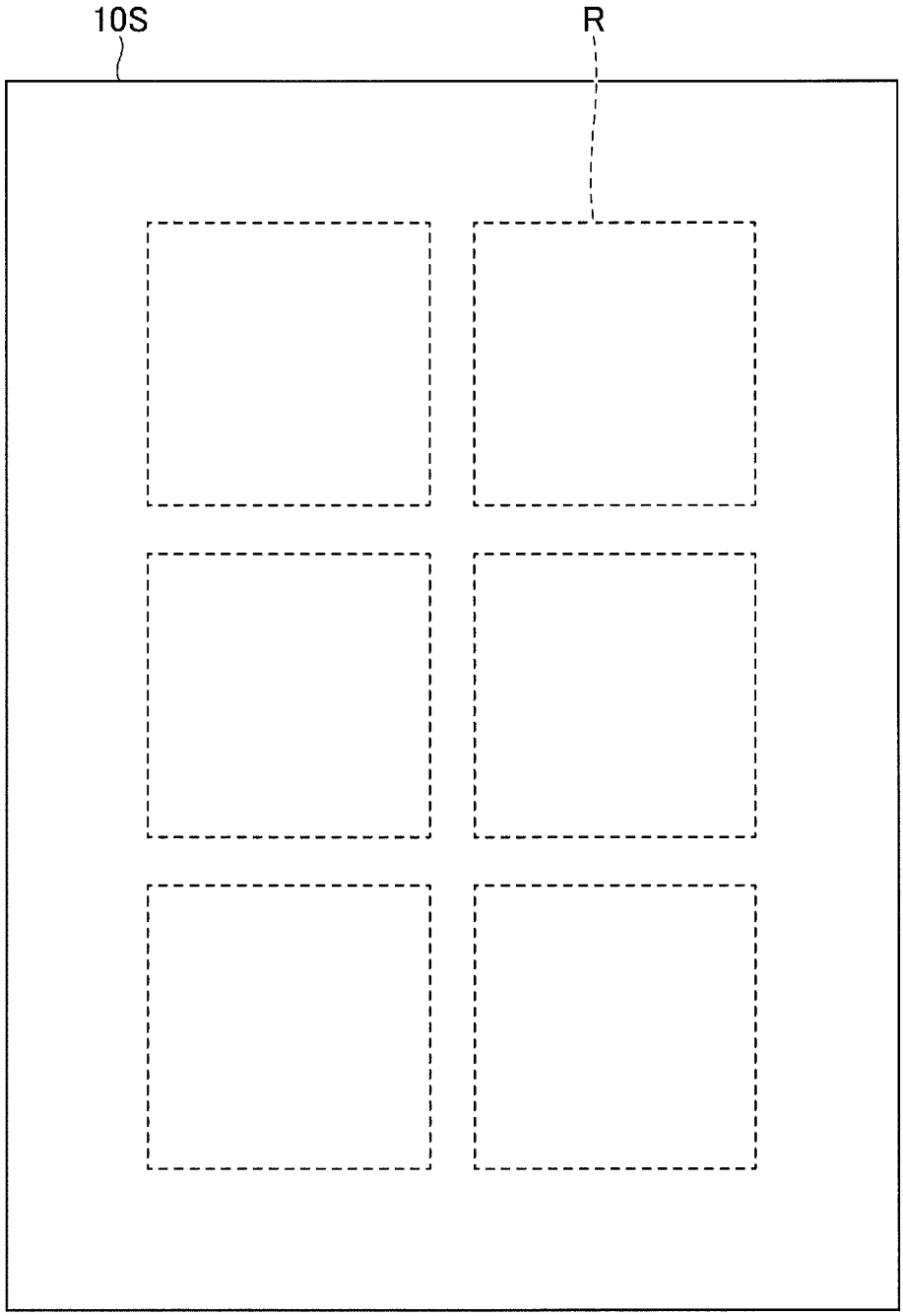
FIG. 3 is a diagram illustrating a manufacturing process of the inductor according to the first embodiment.

First, in the process illustrated in FIG. 3, a metal plate 10S having a planar shape that is a rectangular shape, for example, is prepared. The metal plate 10S is a metal plate for a lead frame, for example. Examples of the material forming the metal plate 10S include copper, copper alloys, Fe—Ni alloys such as 42 alloy, or the like, for example. The metal plate 10S may have a thickness of approximately 60 μm to approximately 120 μm, for example. A plurality of product regions R, indicated by dotted lines, are defined on the surface of the metal plate 10S, and each product region R becomes the inductor 1 when the metal plate 10S is finally cut along the dotted lines into individual pieces. The product regions R may be arranged vertically and horizontally on the surface of the metal plate 10S, for example, however, the number of product regions R is not limited to six. FIG. 4A through FIG. 7C will be described by referring to plan views and cross sections corresponding to one product region R illustrated in FIG. 3.

Next, in the processes illustrated in FIG. 4A through FIG. 5B, the metal plate 10S is patterned, to form the first conductor 111, the first conductor 121, and the first conductor 131. In this example, the metal plate 10S is patterned by etching, however, the metal plate 10S may be patterned by punching, for example.

Figure 4A:
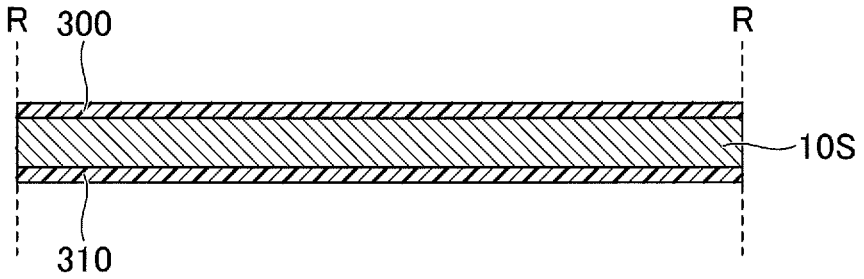
FIG. 4A, FIG. 4B, and FIG. 4C are diagrams illustrating manufacturing processes of the inductor according to the first embodiment.
Figure 4B:
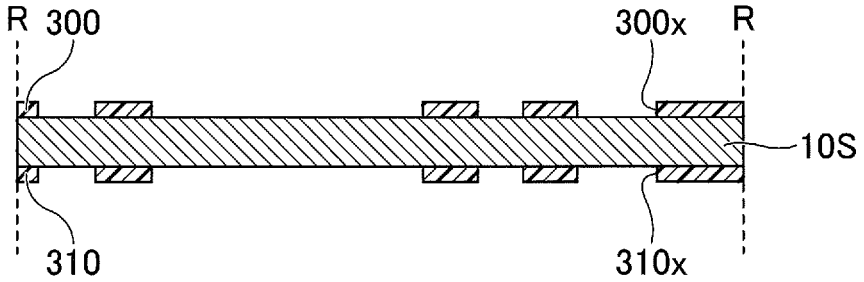
Figure 4C:
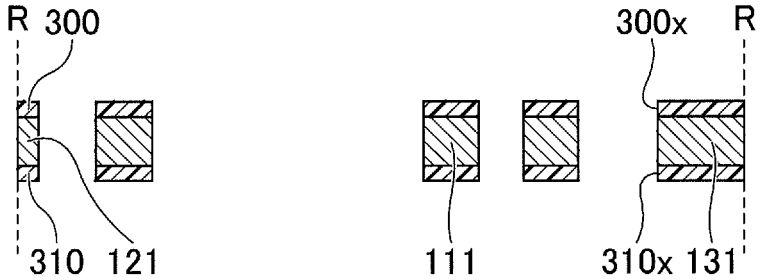

More particularly, first, as illustrated in FIG. 4A, a photosensitive resist layer 300 is formed on the entire upper surface of the metal plate 10S, and a photosensitive resist layer 310 is formed on the entire lower surface of the metal layer 10S. Then, as illustrated in FIG. 4B, the resist layers 300 and 310 are exposed and developed to form openings 300*x* and openings 310*x*, to cover only the regions of the metal plate 10S where the first conductor 111, the first conductor 121, and the first conductor 131 are to be formed. The openings 300*x* and the openings 310*x* are formed at mutually opposing positions via the metal plate 10S. Next, as illustrated in FIG. 4C, the resist layers 300 and 310 are used as masks, to etch both the upper and lower surfaces of the metal plate 10S that are exposed via the openings 300*x* and 310*x*, respectively.

Figure 5A:
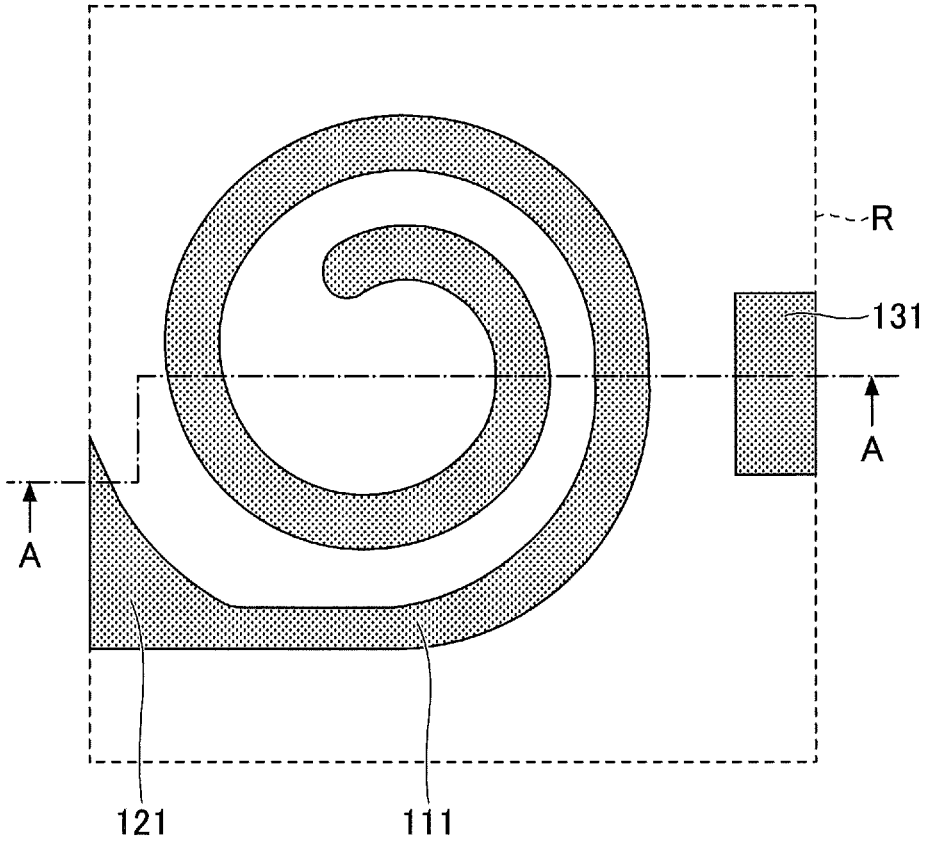
FIG. 5A and FIG. 5B are diagram illustrating manufacturing processes of the inductor according to the first embodiment.
Figure 5B:
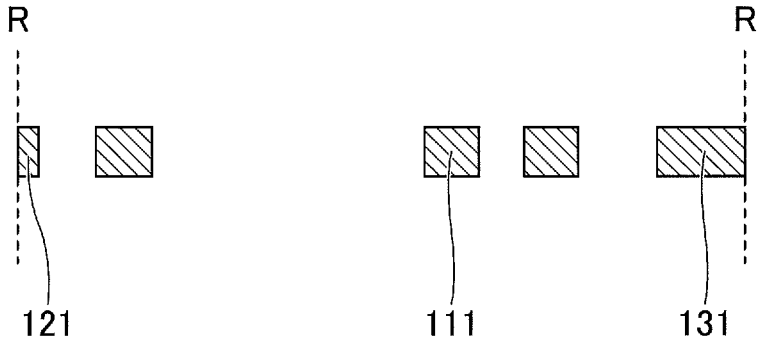

Thereafter, as illustrated in FIG. 5A and FIG. 5B, the resist layers 300 and 310 are removed. Hence, the first conductor 111 that is patterned to a planar shape that is spiral, the first conductor 121 that is patterned to a planar shape that is approximately triangular, and the first conductor 131 that is patterned to a planar shape that is approximately rectangular, are formed. The first conductor 121 is integrally formed on the first conductor 111 at one end of the first conductor 111, and the first conductor 131 is formed independently of the first conductor 111 and the first conductor 121. The first conductor 121 and the first conductor 131 are supported by an outer frame (not illustrated) of the metal plate 10S positioned on the outer side of the product regions R.

When patterning the metal plate 10S by the etching, a ratio of the thickness of the metal plate 10S with respect to a minimum interval (or minimum pitch) of the immediately adjacent first conductors 111 is approximately 1:1. In addition, when patterning the metal plate 10S by the punching, the ratio of the thickness of the metal plate 10S with respect to the minimum interval of the immediately adjacent first conductors 111 is approximately 1:0.5.

Figure 6A:
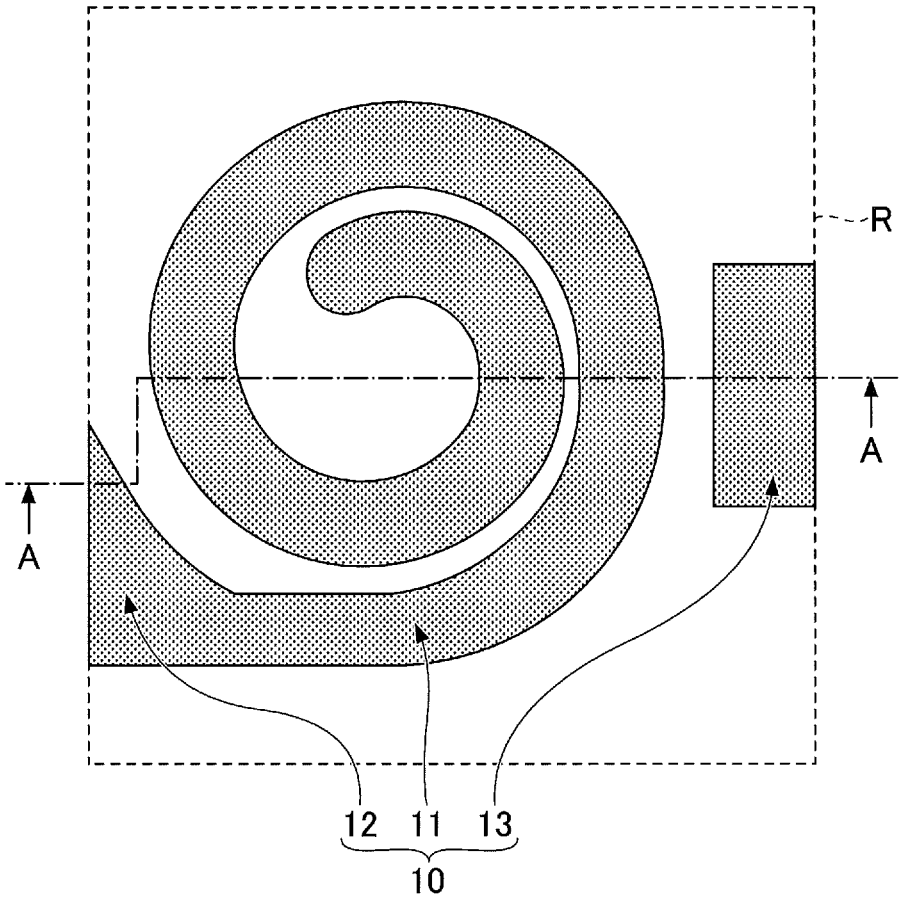
FIG. 6A and FIG. 6B are diagram illustrating manufacturing processes of the inductor according to the first embodiment.
Figure 6B:
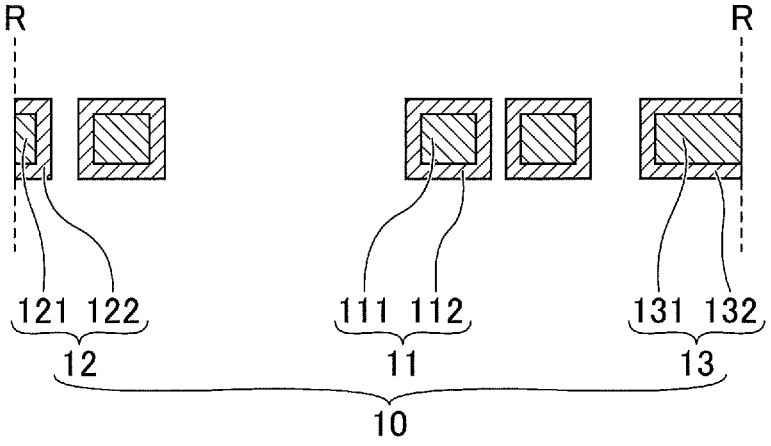

Next, in the processes illustrated in FIG. 6A and FIG. 6B, the second conductor 112 covering the peripheries of the first conductor 111, the second conductor 122 covering the periphery of the first conductor 121, and the second conductor 132 covering the periphery of the first conductor 131, are formed. The second conductor 122 is integrally formed on the second conductor 112 at one end of the second conductor 112, and the second conductor 132 is formed independently of the second conductor 112 and the second conductor 122. Hence, the conductor pattern 11 including the first conductor 111 and the second conductor 112, the first terminal part 12 including the first conductor 121 and the second conductor 122, and the second terminal part 13 including the first conductor 131 and the second conductor 132, are formed, to complete the conductor 10. The second conductor 112, the second conductor 122, and the second conductor 132 may be formed by electroplating which feeds the first conductor 111, the first conductor 121, and the first conductor 131 from the outer frame of the metal plate 10S, for example.

Figure 7A:
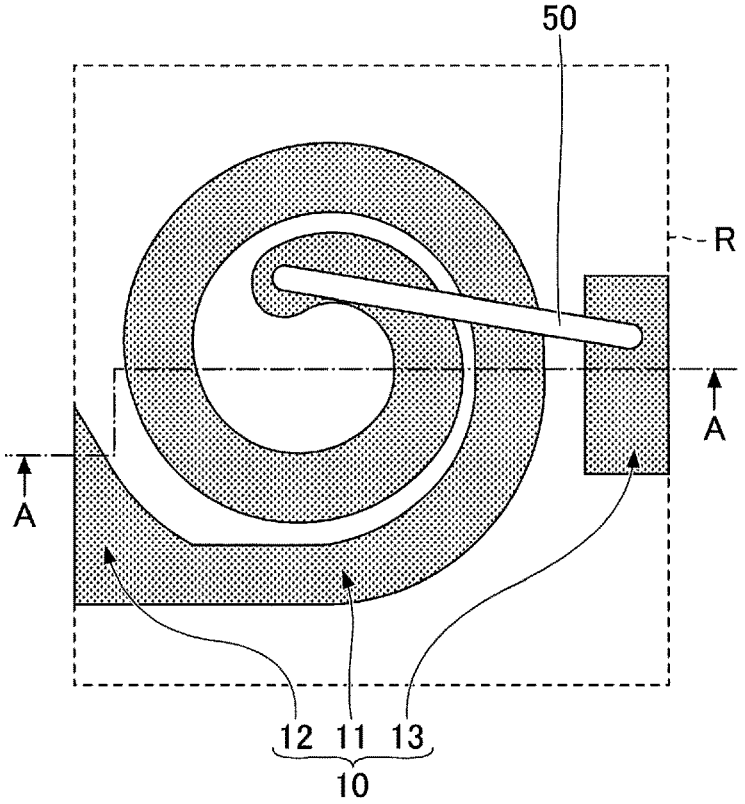
FIG. 7A, FIG. 7B, and FIG. 7C are diagram illustrating manufacturing processes of the inductor according to the first embodiment.

Next, in the process illustrated in FIG. 7A, the other end of the conductor pattern 11 is electrically connected to the second terminal part 13 via the metal wire 50. The metal wire 50 may be a gold wire, a copper wire, an aluminum wire, or the like, for example. The metal wire 50 may be connected to the other end of the conductor pattern 11 or the like by ultrasonic bonding, welding, soldering, or the like, for example. The metal wire 50 is provided so as not to make contact with parts of the conductor pattern 11 other than the other end of the conductor pattern 11. For example, the metal wire 50 may be provided in an arched shape that protrudes upward when viewed in a direction from the cross section of the inductor 1, to avoid contact between the metal wire 50 and the parts of the conductor pattern 11 other than the other end of the conductor pattern 11. The above mentioned electrical connection may be made by a metal ribbon, instead of using the metal wire 50. In this case, materials similar to those usable for the metal wire 50 may be used for the metal ribbon.

Figure 7B:
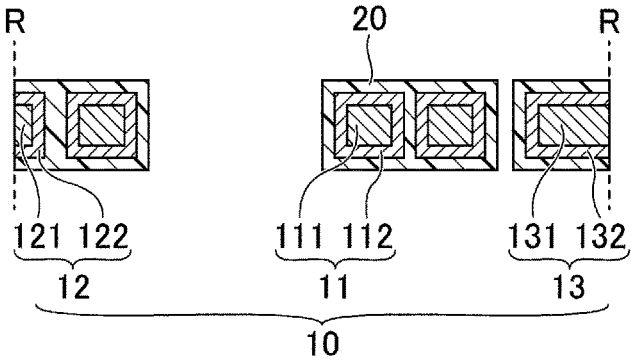

Next, in the process illustrated in FIG. 7B, the insulating layer 20, which covers the periphery of the conductor 10, is formed. More particularly, the insulating layer 20 covers the respective peripheries of the conductor pattern 11, the first terminal part 12, and the second terminal part 13. The insulating layer 20 is also formed on the surface of the metal wire 50. The insulating layer 20 may be formed by electrodeposition coating, spin-coating, dip coating, or the like, for example. The material used for the insulating layer 20 and the thickness of the insulating layer 20 may be the same as those described above.

Figure 7C:
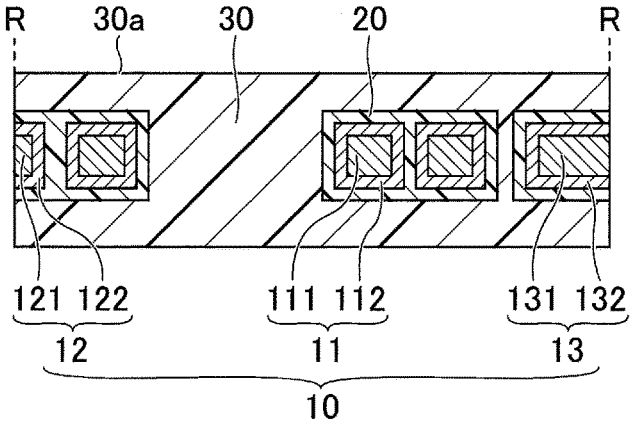

Next, in the process illustrated in FIG. 7C, the magnetic body 30, which covers the insulating layer 20, is formed. The magnetic body 30 may be molded, by filling the periphery of the structure illustrated in FIG. 7B with a powder mixture which is obtained by mixing the above mentioned magnetic powder and the insulating resin (or binder), and applying a pressure of approximately 15 KN from above and under the structure while heating the powder mixture to approximately 160° C., for example.

By appropriately selecting the material used for the insulating resin (or binder) and adjusting the mixing ratio of the insulating resin (or binder) with respect to the magnetic powder, it is also possible to mold the magnetic body 30 by a low-pressure molding, such as transfer molding, compression molding, or the like.

In the case of the compression molding, the structure illustrated in FIG. 7B and the powder mixture of the magnetic powder and the insulating resin (or binder) are set within a cavity of a mold, the mold is heated and a pressure is applied, to mold the magnetic body 30, for example. In this case, the magnetic body 30 may be molded using the mold, by applying a pressure of approximately 15 KN from above and under the structure while heating the powder mixture to approximately 160° C., for example.

Alternatively, in the case of the transfer molding, the structure illustrated in FIG. 7B is set within the cavity of the mold, and a thermosetting resin including the magnetic powder is injected into the cavity, to mold the magnetic body 30, for example.

Next, in the process illustrated in FIG. 8, the structure illustrated in FIG. 7C is arranged on a support 500, and an elongated groove 500*x*, which penetrates this structure, is formed along each first pair of opposing side surfaces in the product regions R of the structure in the vertical direction in FIG. 8. The grooves 500*x* may be formed using a dicing blade or the like, for example. In the groove 500*x*, the first terminal part 12 is partially exposed from the side surface 30*c* of the magnetic body 30, and the second terminal part 13 is partially exposed from the side surface 30*d* of the magnetic body 30, at each product region R. In addition, the outer frame of the metal plate 10S, positioned on the outer side of the product region R, is removed.

Next, in the process illustrated in FIG. 9, the electrodes 41 and 42 are formed on the structure illustrated in FIG. 8. The electrode 41 is formed on the upper surface 30*a* of the magnetic body 30 at the position on the side of the side surface 30*c*, and extends from the upper surface 30*a* to the entire side surface 30*c*, and this electrode 41 vertically spans three product regions R in the example illustrated in FIG. 9. In addition, the electrode 41 is electrically connected to the part of the first terminal part 12 exposed from the side surface 30*c* of the magnetic body 30. On the other hand, the electrode 42 is formed on the upper surface 30*a* of the magnetic body 30 at the position on the side of the side surface 30*d*, and extends from the upper surface 30*a* to the entire side surface 30*d*, and this electrode 42 vertically spans three product regions R in the example illustrated in FIG. 9. In addition, the electrode 42 is electrically connected to the part of the second terminal part 13 exposed from the side surface 30*d* of the magnetic body 30.

When forming the electrodes 41 and 42, a seed layer is formed on the upper surface 30*a* of the magnetic body 30 to extend from the position on the side of the side surface 30*c* to the entire side surface 30*c*, and a seed layer is formed on the upper surface 30*a* of the magnetic body 30 to extend from the position on the side of the side surface 30*d* to the entire side surface 30*d*, and each of these seed layers vertically spans three product regions R in the example illustrated in FIG. 9. The seed layers may have a multi-layer (or stacked) structure including a titanium layer and a copper layer which are stacked in this order, for example. The seed layers may be formed by sputtering, for example. Next, by forming a copper layer or the like on the seed layers by electroplating using the seed layers as feeding layers, the electrodes 41 and 42 are completed.

By the electroplating using the seed layers as the feeding layers, a plated layer may further be formed on the copper layer or the like. The plated layer may have a multi-layer (or stacked) structure including a nickel layer and a tin layer which are stacked in this order, for example. The nickel layer may have a thickness of approximately 2 μm to approximately 3 μm, for example, and the tin layer may have a thickness of approximately 4 μm to approximately 4 μm, for example. The plated layer may have a multi-layer structure including a nickel layer and a gold layer which are stacked in this order, or a multi-layer structure including a silver layer and a tin layer which are stacked in this order, for example. The plated layer functions as an anti-oxidant layer for the electrodes 41 and 42, and also functions to improve a solderability of the electrodes 41 and 42.

Next, in the process illustrated in FIG. 10 with respect to the structure illustrated in FIG. 9, an elongated groove 500*y*, which penetrates this structure, is formed along each second pair of opposing side surfaces in the product regions R of the structure in the horizontal direction. The groove 500*y* extends in a direction approximately perpendicular to the grooves 500*x*. The grooves 500*y* may be formed using the dicing blade or the like, for example. Hence, by removing the outer frame of the metal plate 10S, positioned on the outer side of the product region R, and cutting the metal plate 10S into the individual pieces corresponding to the product regions R, a plurality of inductors 1 are famed.

Accordingly, by covering the periphery of the first conductor 111 with the second conductor 112, it is possible to narrow the interval of the immediately adjacent patterns of the conductor pattern 11 along the width direction thereof in the longitudinal section, and form the patterns of the conductor pattern 11 with a high density. In addition, by covering the periphery of the first conductor 111 with the second conductor 112, it is also possible to increase the cross sectional area of the conductor pattern 11 along the width direction thereof. For these reasons, it is possible to form the inductor 1 that is small compared to the conventional inductor. For example, when obtaining the same inductance value as an inductor according to a second comparison example in which the periphery of the first conductor 111 is not covered by the second conductor 112, the inductor 1 can reduce the external size thereof by more than 10% and less than 20% compared to the size of the inductor according to the second comparison example.

In addition, compared to a method which forms the electroplated layer in one direction on the first conductor 111, the method which forms the second conductor 112, which is the electroplated layer, in the periphery of the first conductor 111, can considerably reduce the plating time.

Modifications of First Embodiment

In modifications of the first embodiment, the conductor forming the inductor is modified. In the modifications of the first embodiment, a description of those parts which are the same as those corresponding parts of the embodiment described above may be omitted.

Figure 11A:
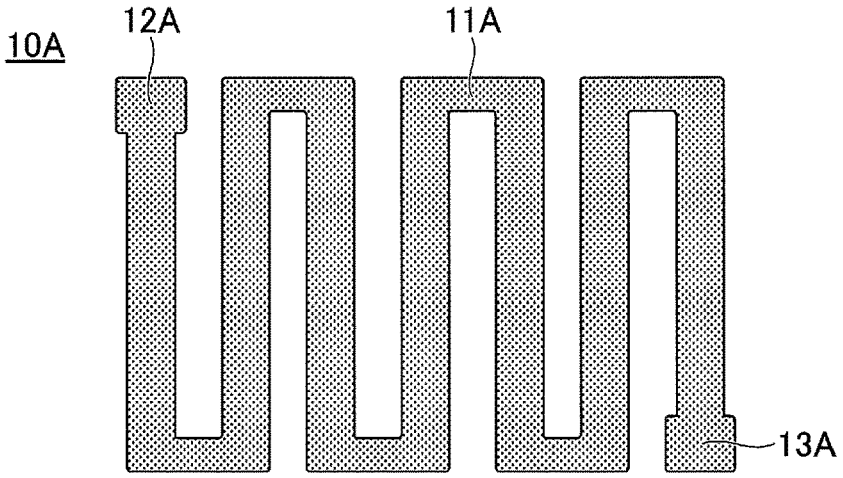
FIG. 11A, FIG. 11B, and FIG. 11C are plan views illustrating modifications of a conductor forming the inductor.
Figure 11B:
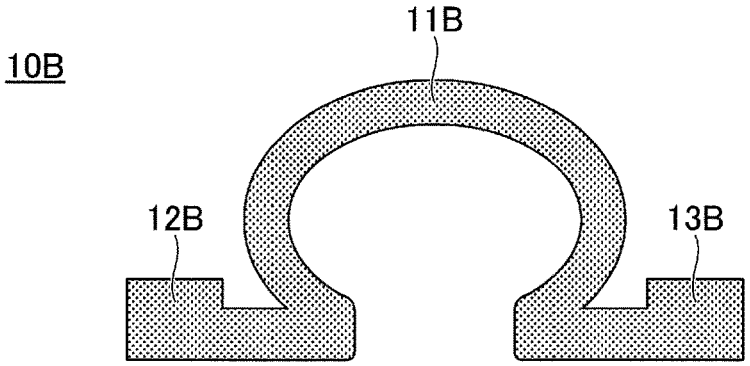
Figure 11C:
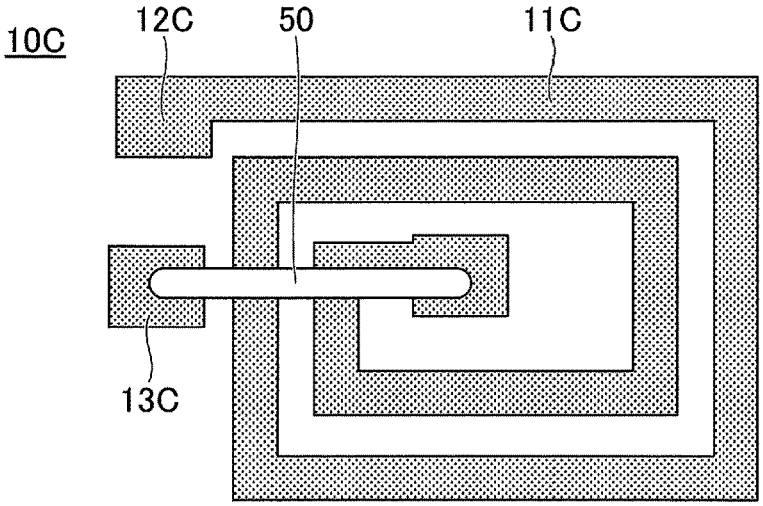

FIG. 11A, FIG. 11B, and FIG. 11C are plan views illustrating the modifications of the conductor forming the inductor. A conductor 10A illustrated in FIG. 11A may be used in place of the conductor 10 illustrated in FIG. 1, FIG. 2A, FIG. 2B, or the like. The conductor 10A includes a conductor pattern 11A that is patterned to a planar shape that is zigzag, a first terminal part 12A that is patterned to a planar shape that is approximately rectangular, and a second terminal part 13A that is patterned to a planar shape that is approximately rectangular. The first terminal part 12A is integrally formed on one end of the conductor pattern 11A, and the second terminal part 13A is integrally formed on the other end of the conductor pattern 11A.

A conductor 10B illustrated in FIG. 11B may be used in place of the conductor 10 illustrated in FIG. 1, FIG. 2A, FIG. 2B, or the like. The conductor 10B includes a conductor pattern 11B that is patterned to a planar shape that is omega-like, a first terminal part 12B that is patterned to a planar shape that is approximately rectangular, and a second terminal part 13B that is patterned to a planar shape that is approximately rectangular. The first terminal part 12B is integrally formed on one end of the conductor pattern 11B, and the second terminal part 13B is integrally formed on the other end of the conductor pattern 11B.

A conductor 100 illustrated in FIG. 11C may be used in place of the conductor 10 illustrated in FIG. 1, FIG. 2A, FIG. 2B, or the like. The conductor 100 includes a conductor pattern 11C that is patterned to a planar shape that is a rectangular spiral, a first terminal part 12C that is patterned to a planar shape that is approximately rectangular, and a second terminal part 13C that is patterned to a planar shape that is approximately rectangular. The first terminal part 12C is integrally formed on one end of the conductor pattern 11C. The second terminal part 13C is arranged independently of the conductor pattern 11C and the first terminal part 12C. The other end of the conductor pattern 11C is electrically connected to the second terminal part 13C via the metal wire 50.

Effects similar to the effects obtainable by the first embodiment can be obtained by employing the structure including the first conductor, and the second conductor covering the periphery of the first conductor, for each of the conductors 10A, 10B, and 100.

The planar shape of the conductor forming the inductor may be any one of the shapes of the conductors 10, 10A, 10B, and 100, or may be other shapes. The planar shape of the conductor forming the inductor may be arbitrarily determined according to required specifications, for example.

Accordingly to each of the embodiment and the modifications described above, it is possible to reduce the size of the inductor compared to conventional inductors.

Various aspects of the subject-matter described herein may be set out non-exhaustively in the following numbered clauses:

1. A method of manufacturing an inductor, comprising:
forming a first conductor;
covering a periphery of the first conductor by a second conductor, to form a conductor that includes the first conductor and the second conductor; and embedding the conductor in a magnetic body.

2. The method of manufacturing the inductor according to clause 1, wherein the forming the first conductor forms the first conductor by patterning a metal plate, and the covering the periphery of the first conductor forms the second conductor by electroplating.

3. The method of manufacturing the inductor according to clause 1, further comprising:
forming an insulating layer covering a periphery of the second conductor.

4. The method of manufacturing the inductor according to clause 1, wherein the forming the first conductor forms a conductor pattern having a spiral planar shape.

5. The method of manufacturing the inductor according to clause 4, wherein an interval of immediately adjacent patterns of the conductor pattern along a width direction of the conductor pattern in a longitudinal section is smaller than a thickness of the first conductor.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. An inductor comprising:
a magnetic body; and
a conductor embedded in the magnetic body,
wherein the conductor includes
a first conductor,
a second conductor covering an entire periphery of the first conductor in a longitudinal section,
an insulating layer covering an entire periphery of the second conductor in the longitudinal section, and making direct contact with the magnetic body so that the magnetic body covers an entire periphery of the insulating layer in the longitudinal section.

2. The inductor as claimed in claim 1, wherein the first conductor is formed by a metal plate, and the second conductor is formed by an electroplated layer.

3. The inductor as claimed in claim 1, wherein the magnetic body has a composition including a magnetic powder and an insulating resin.

4. The inductor as claimed in claim 1, wherein a cross sectional shape of the conductor along a width direction thereof in the longitudinal section is approximately rectangular.

5. The inductor as claimed in claim 1, wherein the conductor includes
a conductor pattern having a predetermined planar shape,
a first terminal part electrically connected to one end of the conductor pattern, and
a second terminal part electrically connected to the other end of the conductor pattern,
wherein the first terminal part and the second terminal part are partially exposed from the magnetic body.

6. The inductor as claimed in claim 5, wherein
the conductor pattern has a spiral planar shape,
the first terminal part is integrally formed on the conductor pattern at one end of the conductor pattern,
the second terminal part is arranged independently of the conductor pattern and the first terminal part, and
the other end of the conductor pattern is electrically connected to the second terminal part via a metal wire.

7. The inductor as claimed in claim 5, further comprising:
a pair of electrodes formed on an outer side of the magnetic body, wherein one of the pair of electrodes is electrically connected to a part of the first terminal part exposed from the magnetic body, and the other of the pair of electrodes is electrically connected to a part of the second terminal part exposed from the magnetic body.

8. The inductor as claimed in claim 5, wherein an interval of immediately adjacent patterns of the conductor pattern along a width direction thereof in the longitudinal section is smaller than a thickness of the first conductor.

9. The inductor as claimed in claim 1, wherein the second conductor has an approximately constant thickness.

10. The inductor as claimed in claim 9, wherein the insulating layer has an approximately constant thickness.

* * * * *